US005286307A

United States Patent [19]

Anderson

[11] Patent Number: 5,286,307

[45] Date of Patent: Feb. 15, 1994

[54] PROCESS FOR MAKING ND-B-FE TYPE MAGNETS UTILIZING A HYDROGEN AND OXYGEN TREATMENT

[75] Inventor: Richard L. Anderson, Marengo, Ill.

[73] Assignee: SPS Technologies, Inc., Newtown, Pa.

[21] Appl. No.: 871,831

[22] Filed: Apr. 21, 1992

Related U.S. Application Data

[62] Division of Ser. No. 403,697, Sep. 6, 1989, Pat. No. 5,129,964.

[51] Int. Cl.[5] ..... H01F 1/053

[52] U.S. Cl. ..... 148/302; 148/301; 420/83; 420/121

[58] Field of Search ..... 148/301, 302, 303; 420/83, 121

[56] References Cited

U.S. PATENT DOCUMENTS

| | | | |
|---|---|---|---|
| 4,588,439 | 5/1986 | Narasimhan et al. | 148/302 |
| 4,597,938 | 7/1986 | Matsuura et al. | 419/23 |
| 4,601,875 | 7/1986 | Yamamoto et al. | 419/23 |
| 4,663,006 | 5/1987 | Furchart et al. | 252/62.51 |
| 4,684,406 | 8/1987 | Matsuura et al. | 75/244 |
| 4,760,966 | 8/1988 | Finnegan et al. | 241/1 |
| 4,770,723 | 9/1988 | Sagawa et al. | 148/302 |
| 4,857,118 | 8/1989 | Van Mens et al. | 148/103 |
| 4,911,882 | 3/1990 | Greenwald et al. | 419/12 |

FOREIGN PATENT DOCUMENTS

| | | |
|---|---|---|
| 20101552 | 2/1984 | European Pat. Off. . |
| 10126179 | 11/1984 | European Pat. Off. . |
| 10126802 | 12/1984 | European Pat. Off. . |
| 10134305 | 3/1985 | European Pat. Off. . |
| 0280372 | 8/1988 | European Pat. Off. . |
| 0304054 | 2/1989 | European Pat. Off. . |
| 51-133797 | 11/1976 | Japan . |
| 57-134533 | 8/1982 | Japan . |
| 60-63304 | 4/1985 | Japan . |
| 61-199005 | 9/1986 | Japan . |
| 62-112702 | 5/1987 | Japan . |
| 62-257705 | 11/1987 | Japan . |
| 63-301505 | 12/1988 | Japan . |
| 1-172501 | 7/1989 | Japan . |
| 1554384 | 10/1979 | United Kingdom . |
| 2100286 | 12/1982 | United Kingdom . |

OTHER PUBLICATIONS

J. Omerod, J. of the Less-Common Metals, 111 49-69 (1985).

C. Herget, Mettalurgical Ways to NdFeB Alloys. Permanent Magnets from Co-reduced NdFeB, 8th International Workshop on Rare-Earth Magnets and Their Applications, Dayton, Ohio, May 6-8, 1985.

J. Omerod, Processing and Physical Metallurgy of NdFeB and Other Rare Earth Magnets, Nd-Fe Permanent Magnets-Their Present and Future Applications, Report and Proceedings of Workshop Meeting Held in Brussels on Oct. 25, 1984.

(List continued on next page.)

*Primary Examiner*—John P. Sheehan

*Attorney, Agent, or Firm*—Curtis, Morris & Safford

[57] ABSTRACT

A process for preparing a permanent magnet is disclosed. The process comprises the steps of exposing material, in particulate form, and having an overall composition comprising 8 to 30 atomic percent of a first constituent selected from the group consisting of rare earth metals, 42 to 90 atomic percent of a second constituent selected from the group consisting of transition metals and 2 to 28 atomic percent of a third constituent selected from the group consisting of substances from Group III of the Periodic Table, to hydrogen gas under conditions such that hydrogen gas is absorbed by the material, exposing the hydrided material, in particulate form, to oxygen or an oxygen-containing gas in an amount and for a period of time sufficient to passivate the material, and compacting the material. Also disclosed are products from this process, namely, passivated, hydrided particles, alloy compacts formed of passivated, hydrided material and permanent magnets, having superior properties.

5 Claims, 1 Drawing Sheet

OTHER PUBLICATIONS

J. Omerod, The Physical Metallurgy and Processing of Sintered Rare Earth Permanent Magnets, International Rare Earth Conference, ETH Zurich, Switzerland, Mar. 4–8, 1985.

I. R. Harris et al., J. of the Less-Common Metals, 106 L1–4 (1985).

P. J. McGuiness et al., J. of Materials Science 21 4107–4110 (1986).

K. S. V. L. Narasinhan, J. Appl. Phys. 57 4081–4085 (1985).

R. E. Johnson, Rare-Earth Cobalt Permanent Magnets Containing Praseodymium, Cobalt, 1 21–24 (1974).

H. Oesterreicher, Proceedings of the Second International Symposium on Magnetic Anisotropy and Coercivity in Rare Earth-Translation Metal-Alloys, San Diego, California, Jul. 1, 1978, pp. 54–64.

McGuiness et al., The Production of a Nd-Fe-B Permanent Magnet by a Hydrogen Depreciation/Attritator Milling Route, J. Mat. Sci., 1986, 21, 4107–4110.

E. P. Wohlfarth et al., Ferromagnetic Materials, vol. 4, 1988, p. 78, North Holland Publishing Co., Amsterdam, NL, para. 1–2.

Patent Abstracts of Japan, vol. 13, No. 139 (E-738) [3487], 6th Apr. 1989; JP-A-63 301 505 (Hitachi Metals Ltd.), Dec. 8, 1988.

Search Report for EP 90 11 7124 (EP 90 11 7124 corresponds to above-captioned application).

PROCESS FOR MAKING ND-B-FE TYPE MAGNETS UTILIZING A HYDROGEN AND OXYGEN TREATMENT

This application is a division of application Ser. No. 07/403,697, filed Sep. 6, 1989, now U.S. Pat. No. 5,129,964.

FIELD OF THE INVENTION

The present invention relates to permanent magnets and a process for the manufacture thereof.

BACKGROUND OF THE INVENTION

Alloys containing rare earth elements (R) have excellent magnetic properties and are used for permanent magnets. Especially advantageously used for permanent magnets are R-FE-B alloys such as, for example, Nd-Fe-B. By using R-FE-B alloys, permanent magnets having excellent characteristics are obtained by mechanically crushing and pulverizing an ingot of the alloy into a fine powder followed by compacting in a magnetic field, sintering and heat treating.

However, in the processing of R-FE-B alloy powder into a permanent magnet material, the powder—especially when milled to a three-micron mean diameter size—is typically excessively reactive with air. Even when the final milling is carried out under hexane, this excessive reactivity causes the powder to burn when it comes into contact with air or oxygen-containing gas. Loss of large quantities of alloy powder by burning is commonplace in the magnet industry, especially during compaction, and prevents the attainment of high permanent magnetic quality. This burning phenomenon not only is economically disadvantageous due to loss of large quantities of alloy powder but also is a safety hazard. Accordingly, processing techniques which do not effectively counteract this phenomenon are disadvantageous.

OBJECTS OF THE INVENTION

It is therefore an object of the present invention to provide (1) a process which circumvents the excessive reactivity with air of R-FE-B type alloy powders in order to prevent burning when the powders come into contact with air or oxygen-containing gas and consequent loss of alloy powder and (2) products from this process, namely, passivated, hydrided particles, alloy compacts formed of passivated, hydrided material and permanent magnets, having superior properties.

It is another object of the present invention to provide a process which is economical and safe.

It is another object of the process of the present invention to combine hydrogenization and controlled oxidation of R-FE-B type alloy powders in conjunction with compacting and sintering.

It is a further object of the process of the present invention to reduce the sensitivity of fine R-Fe-B type alloy powders to further oxidation.

It is another object of the invention to reduce the loss of alloy powder due to burning.

It is yet another object of the invention to reduce the fire hazard when alloy powders come into contact with an oxygen-containing gas.

It is a further object of the process of the present invention to reduce milling time of R-FE-B type alloy powders.

It is another object of the process of the present invention to reduce the strength of the magnetic field required for alignment during powder-pressing of R-Fe-B type alloy powders.

It is yet another object of the present invention to provide products exhibiting exceptionally high magnetic quality.

Various other objects, advantages and features of the invention will become readily apparent from the ensuing description of the invention.

SUMMARY OF THE INVENTION

In one aspect, the invention is a process for preparing a permanent magnet comprising the steps of exposing material, in particulate form, and having an overall composition comprising 8 to 30 atomic percent of a first constituent selected from the group consisting of rare earth metals, 42 to 90 atomic percent of a second constituent selected from the group consisting of transition metals and 2 to 28 atomic percent of a third constituent selected from the group consisting of substances from Group III of the Periodic Table, to hydrogen gas under conditions such that hydrogen gas is absorbed by the material exposing the hydrided material, in finer particulate form, to oxygen or an oxygen-containing gas in an amount and for a period of time sufficient to passivate the material, and compacting the material.

In another aspect, the invention is a hydrided, passivated particle having a composition comprising a first constituent selected from the group consisting of rare earth metals, a second constituent selected from the group consisting of transition metals and a third constituent selected from the group consisting of substances from Group III of the Periodic Table, and having an intrinsic coercivity of greater than 1,000 Oersted, a hydrogen content of 0.1 to 25 atomic percent and an oxygen content of 2.0 to 10 atomic percent.

In still another aspect, the invention is a hydrided, passivated particle, having an intrinsic coercivity of greater than 1,000 Oersted, a hydrogen content of 0.1 to 25 atomic percent and an oxygen content of 2.0 to 10 atomic percent, which is prepared by a process comprising the steps of providing a particle of material having a composition comprising a first constituent selected from the group consisting of rare earth metals, a second constituent selected from the group consisting of transition metals and a third constituent selected from the group consisting of substances from Group III of the Periodic Table, which material has been exposed to hydrogen gas under conditions such that the hydrogen gas is absorbed thereby; and exposing the particle of hydrided material to oxygen or an oxygen-containing gas in an amount, and for a time, sufficient to passivate the particle.

In yet another aspect, the invention is a hydrided, passivated, alloy compact having an overall composition comprising a first constituent selected from the group consisting of rare earth metals, a second constituent selected from the group consisting of transition metals and a third constituent selected from the group consisting of substances from Group III of the Periodic Table, and having an intrinsic coercivity of greater than 1,000 Oersted, a hydrogen content of 0.1 to 25 atomic percent and an oxygen content of 2.0 to 10 atomic percent.

In another aspect, the invention is a hydrided, passivated, alloy compact having an overall composition comprising a first constituent selected from the group consisting of rare earth metals, a second constituent selected from the group consisting of transition metals and a third constituent selected from the group consisting of substances from Group III of the Periodic Table, and having an intrinsic coercivity of greater than 1,000 Oersted, a hydrogen content of 0.1 to 25 atomic percent and an oxygen content of 2.0 atomic percent which is prepared by a process comprising the steps of providing particulate material having an overall composition comprising a first constituent selected from the group consisting of rare earth metals, a second constituent selected from the group consisting of transition metals and a third constituent selected from the group consisting of substances from Group III of the Periodic Table, which material has been exposed to hydrogen under conditions such that the hydrogen gas is absorbed by said material, exposing the particulate hydrided material to oxygen or an oxygen-containing gas in an amount, and for a time, sufficient to passivate the particles, and compacting the passivated particles.

In another aspect, the invention is a permanent magnet comprising a passivated, compacted and sintered alloy having an overall composition comprising a first constituent selected from the group consisting of rare earth metals, a second constituent selected from the group consisting of transition metals, and a third constituent selected from the group consisting of substances from Group III of the Periodic Table, and having an intrinsic coercivity of greater than 8,000 Oersted and an oxygen content of 2 to 10 atomic percent oxygen.

In yet another aspect, the invention is a permanent magnet having an intrinsic coercivity of greater than 8,000 Oersted and an oxygen content of 2 to 10 atomic percent, which is prepared by a process comprising the steps of providing particulate material having an overall composition comprising a first constituent selected from the group consisting of rare earth metals, a second constituent selected from the group consisting of transition metals, and a third constituent selected from the group consisting of substances from Group III of the Periodic Table, which material has been exposed to hydrogen gas under conditions such that hydrogen gas is absorbed by the material, exposing the hydrided material to oxygen or an oxygen-containing gas in an amount and for a time, sufficient to passivate the material, orienting the material in a magnetic field of greater than 6 KOe, compacting the material, and sintering the material.

Practice of the process of the present invention, which combines hydrogenization and controlled oxidation of R-FE-B type powders prior to compacting and sintering, confers the distinct advantages of reduced sensitivity of the fine powder to further oxidation (e.g. spontaneous combustion), reduced milling time, reduced strength of the magnetic field required for alignment during powder-pressing and products exhibiting exceptionally high magnetic quality.

DESCRIPTION OF THE DRAWINGS

Various other objects, advantages and features of the invention will become readily apparent from the ensuing detailed description, when read with reference to the accompanying figure which shows the effect of alignment field strength on the energy product of sintered Nd-Fe-B magnets produced from, respectively, passivated and hydrided powder and passivated and non-hydrided powder.

DESCRIPTION OF CERTAIN PREFERRED EMBODIMENTS OF THE INVENTION

Figure 1:
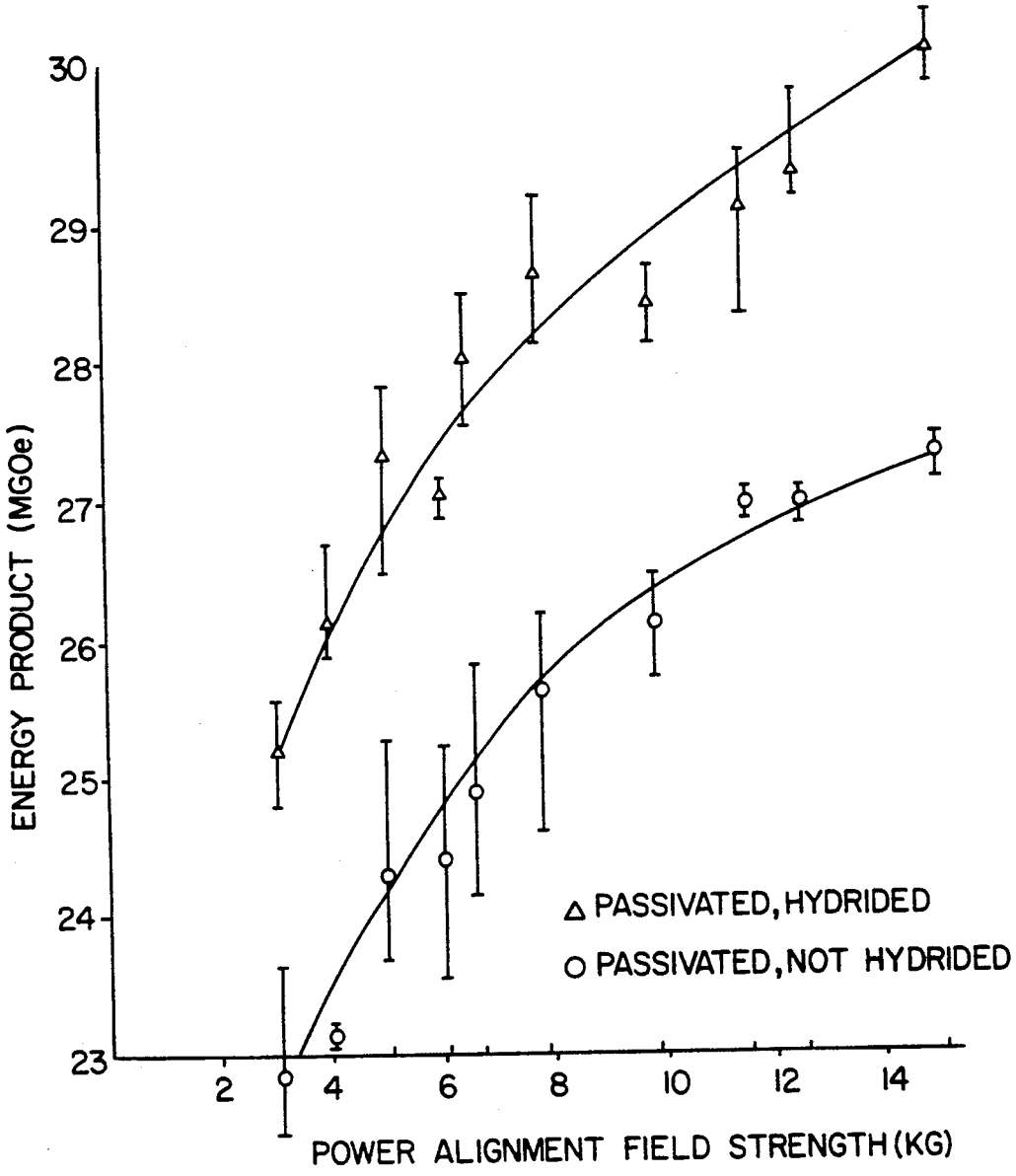

The material in particulate form typically has an overall composition comprising about 8 to 30 atomic percent of a first constituent selected from the group consisting of rare earth metals, about 42 to 90 atomic percent of a second constituent selected from the group consisting of transition metals and about 2 to 28 atomic percent of a third constituent selected from the group consisting of substances from Group III of the Periodic Table of elements.

Rare earth metals which can be utilized in practicing the invention include the elements, atomic numbers 57 to 71, of the periodic system. The rare earth metal constituent can be a single rare earth metal or a combination of two or more rare earth metals. Preferred rare earth metals include neodymium, praseodymium and dysprosium.

Suitable transition metals include elements 21 through 29, 39 through 47, 57 through 79 and all known elements from 89 on. A preferred transition metal is Fe. The aforementioned second constituent can be a single transition metal or a combination of two or more transition metals. For example, elemental powders of Fe and Co can be added or an alloy of Fe and Co can be added.

The third constituent is a substance from Group III of the periodic table, including boron, aluminum, gallium, indium and thallium. A preferred Group III substance is boron. The third constituent can be a combination of two or more Group III substances. For example, the third constituent can be a combination of boron and aluminum wherein the aluminum is added as an elemental powder or as an alloy with iron.

In one embodiment of the invention, the material in particulate form has an overall composition comprising 15.9 atomic percent of neodymium, 6.4 atomic percent boron, 0.4 atomic percent praseodymium and 77.3 atomic percent iron. In another embodiment, the material in particulate form has an overall composition comprising 15.7 atomic percent neodymium, 1.1 atomic percent dysprosium, 0.4 atomic percent praseodymium, 6.4 atomic percent boron and 76.4 atomic percent iron.

Advantageously, the material in particulate form is prealloyed. Typically, the material in particulate form is prepared by incorporating the first, second and third constituents to obtain a mixture having a given composition within the above-mentioned compositional range; the mixture is melted (for instance, vacuum melted) under argon partial pressure using a high-frequency induction furnace or like equipment; the melt is then comminuted and formed into powder particles, cast into crystalline ingots or chill-cast into fragments. The crystalline ingots or chill-cast fragments can be jaw-crushed under an inert atmosphere to a particle size no greater than 6 mm in maximum dimension.

The particles can then be further disk- or impact-milled if necessary or desirable, under an inert atmosphere and screened to a particle size no greater than 4,000 microns in maximum dimension. During the milling procedure, liquid nitrogen is typically fed to the milling chamber in order to remove the heat of milling and to maintain the brittleness of the alloy, to facilitate more efficient size reduction and to minimize the introduction of deformation-induced defects. Material larger than 4,000 microns is returned to the mill for re-milling. Preferably, the particle size after screening is no greater than 2,000 microns in maximum dimension, more preferably no greater than 400 microns in maximum dimension.

The milled and screened material is then placed in a reaction vessel advantageously equipped with heating-/cooling means and means for creating vacuum in the vessel. An example of a preferred reaction vessel is a water-jacketed vacuum chamber. The pressure in the vessel is reduced below 100 Torr, preferably below about 1 Torr. Once the vessel is evacuated, hydrogen gas is supplied to the vessel at a pressure such that the gage pressure inside the vessel is maintained at −90 to +100 Kilopascale (kPa), preferably −90 to +35 kPa, more preferably at −20 to +7 kPa. Advantageously, once hydrogen gas is supplied to the vessel, the gage pressure inside the vessel is maintained at −20 kPa. The vessel can be heated in order to initiate absorption of hydrogen by the material in the vessel. For example, in the case where the vessel is a water-jacketed vacuum chamber, hot water may be pumped through the jacket in order to initiate hydrogen absorption. As the material within the vessel absorbs hydrogen, the hydrogen gas pressure is adjusted to maintain the preset hydrogen partial pressure in the vessel. Advantageously, the vessel can be fitted with a gas inlet valve which opens and closes automatically to maintain the preset hydrogen partial pressure in the vessel.

The absorption of hydrogen by the material in the vessel is a strongly exothermic reaction. Accordingly, the material in the vessel is maintained at a temperature ranging from 10° to 370° C. This can be accomplished with cooling means, for example, by passing cool water through the water-jacket of the vacuum chamber. Preferably, the material in the vessel is maintained at a temperature ranging from 27° to 370° C., more preferably from 50° to 340° C., especially at a temperature of 70° C.

Hydrogen gas is supplied to the vessel until such time as it is no longer absorbed in appreciable amount by the material, typically in the range of from about 2 to 6 hours. After hydriding, the material will have a hydrogen content of 0.1 to 25 atomic percent, preferably 5 to 25 atomic percent, more preferably 15 to 25 atomic percent. For Nd-Fe-B magnets, an advantageous hydrogen content is 24 atomic percent. The material in the vessel is subsequently cooled to a temperature from 10° to 65° C., preferably 15° to 55° C., more preferably from 32° to 52° C., especially below 52° C.

When hydrogen absorption is complete and the material in the vessel is sufficiently cooled, the material is transferred from the vessel to an attritor mill (or stirred ball mill) and is milled to a particle size of no greater than 40 microns in maximum dimension, preferably no greater than 30 microns in maximum dimension, more preferably no greater than 20 microns in maximum dimension. Typically, the hydrided material is reduced to a particle size having an average maximum dimension of 2.7 to 3.5 microns as measured by a suitable particle measuring device, e.g., a Fischer sub-sieve sizer. The attritor mill is charged with the hydrided material and a suitable hydrocarbon liquid which serves to remove the heat generated during grinding and to prevent oxidation of the material during fine powder preparation. Suitable hydrocarbon liquids are those with boiling points sufficiently low to facilitate later evaporation of the liquid. These include, for example, acetone, hexane, heptane, toluene, and the like, with hexane being preferred. Alloys or other materials of different chemical composition can also be added to the attritor mill, e.g., cobalt, aluminum, iron-cobalt alloy or iron-aluminum alloy, so as to produce a final alloy having a specified composition within the overall composition ranges recited above. Milling is carried out for a period of time sufficient to obtain the desired particle size.

The hydrocarbon/alloy slurry can then be discharged to settling tanks where the slurry is allowed to stand for a period of time sufficient for the alloy to separate from the hydrocarbon and settle, usually after a period of several minutes. The hydrocarbon is decanted and the densified slurry is discharged to pails which are then placed in evaporation chambers for drying.

The evaporation chamber is advantageously fitted with a water jacket. Before evaporation is initiated, the chamber is purged with nitrogen to remove residual air in the chamber. The chamber is then heated to a temperature of 70° to 90° C., e.g., in the case of a jacketed chamber by passing hot water through the jacket, in order to initiate evaporation of the hydrocarbon. The hydrocarbon is advantageously remotely condensed for reuse in the process. The chamber is heated until the evaporation of the hydrocarbon ceases at which point the chamber is again purged with nitrogen to reduce residual hydrocarbon vapors. The pressure in the chamber is then reduced below 100 Torr, preferably below 1 Torr, for 15–30 minutes and is then back-filled with an inert gas, e.g., argon or nitrogen, to nearly atmosphere pressure. Heating is discontinued and the chamber is cooled. When the temperature drops to 50° C., the pressure in the chamber is further reduced to 10 to 30 milli Torr in order to remove final traces of hydrocarbon and any moisture.

In order to passivate the hydrided powder, the chamber is backfilled with oxygen or an oxygen-containing gas so that pressure in the chamber is at least atmospheric pressure, preferably a slight positive gage pressure (e.g., +7 kPa); the chamber is maintained at a temperature of from 32° to 85° C. Usually it is disadvantageous for the temperature of the chamber to drop below 32° C. during passivation. Preferably, an oxygen-containing gas is used for passivation. An "oxygen-containing gas" as used herein refers to a mixture of an inert gas and air. An inert gas is any gas which does not react with the alloy powder being passivated. Inert gases include nitrogen, helium, and argon with nitrogen being preferred for reason of cost. After an initial holding period of several minutes, a slow purge with a lean air-inert gas mixture is established to apply a passivating oxide surface on the powder. The purpose of the initial holding period is to establish a positive pressure condition in the powder chamber to insure that the powder is exposed only to the passivating gas mixture as the chamber is set up for continuous purging. This treatment makes it possible to handle the powder in air during subsequent compaction without spontaneous combustion. In a preferred embodiment, a mixture of nitrogen and air is used, comprising 75 to 98 volume percent nitrogen and 2 to 25 volume percent air, preferably 80 to 98 volume percent nitrogen and 2 to 20 volume percent air, more preferably 85 to 98 volume percent nitrogen and 2 to 15 volume percent air. The alloy powder is exposed to the oxygen or oxygen-containing gas for a period of time sufficient to passivate the powder, usually for a period of time ranging from 0.1 to 300 hours, preferably from 0.5 to 50 hours, more preferably from 2 to 4 hours.

The passivated alloy powders are placed in a die of desired shape and oriented in a magnetic field of greater than 6 KOe. The powders are then compacted in the die at pressures of 2.8 metric tons per square centimeter. The direction of the orienting magnetic field and the direction of compaction can be parallel or perpendicular. Magnets with higher energy products are obtained when the directions are perpendicular. "Energy product" ($BH_{max}$) is a well known indicator of the quality of a magnet; the higher the energy product, the better the magnet.

The resulting green compacts are then sintered under an inert gas atmosphere, e.g., under argon atmosphere, at a vacuum partial pressure of 2 Torr. In one embodiment of the invention, the green compact is slowly heated to 760° C. in order to allow desorption of hydrogen and purification of the green compact; heated to 1060° C. and held at that temperature for 4 hours; immediately cooled to 925° C. and held at that temperature for two hours; cooled at a rate of 33° C. per hour to 650° C. and held at that temperature for one hour; and then rapidly cooled with nitrogen gas to room temperature.

The resulting sintered magnets are then heat treated in a vacuum in order to increase the intrinsic coercivity ($H_{ci}$). In one embodiment, the sintered magnet is heated to a temperature from 450° C. to 600° C. for two hours and then cooled rapidly with nitrogen gas to room temperature. The sintered and heat treated magnets prepared in accordance with the invention can be abrasive machined to final dimensions and magnetized. The sintered magnets have an oxygen content of 3.2 to 7.7 atomic percent, preferably between 4.0 and 7.7 atomic percent. Advantageously, appropriate plating(s) or coating(s) can be applied for environmental protection of the magnets.

The passivation of hydrided powder by controlled oxidation in accordance with the process of the invention yields magnets with better magnetic properties as compared to the passivation of powder which has not been hydrided. This is graphically demonstrated by FIG. 1 which shows the effect of alignment field strength on the energy product of sintered Nd-B-Fe magnets produced from passivated hydrided powder in accordance with the invention and from passivated non-hydrided powder. FIG. 1 indicates that magnets produced from passivated hydrided powder have higher energy products than magnets produced from passivated non-hydrided powder. It is believed that the benefit of desorbing pure hydrogen during the sintering of Nd-B-Fe serves to activate the sintering process, since the hydrogen counteracts the normally detrimental effect of oxidation. Another advantage of using hydrided powders in accordance with the process of the present invention is that lower field strengths will adequately orient hydrided powder, as is also illustrated by FIG. 1. For example, in order to produce a magnet with an energy product of 27 MGOe, hydrided powder requires a magnetic field of only 6 KOe as compared to a magnetic field of 13 KOe required for non-hydrided powder. It is believed that the lower field strengths are the result of the lower anisotropy field for $Nd_2Fe_{14}BH_{2.7}$, which is 20 KOe as compared to 63 KOe for $Nd_2Fe_{14}B$.

Still another advantage of the process of the invention lies in the use of hydrided powder in the final milling step. Since hydrided powder is more brittle, it requires substantially less milling time. Furthermore, scanning electron microscopy studies show that shorter milling time results in less submicron debris being generated during milling. It is believed that this debris contributes to greater oxygen reactivity and lower magnet quality.

The invention will be more fully described and understood with reference to the following examples which are given by way of illustration.

EXAMPLE 1

1. Two alloys were prepared by vacuum melting under argon partial pressure and casting to produce crystalline ingots. The two alloy compositions expressed in atomic percent were produced as follows:

| | % Nd | % Dy | % Pr | % Al | % B | % Fe |
|---|---|---|---|---|---|---|
| Alloy #1 | 15.8 | 0,07 | 0.23 | 0.52 | 6.69 | 76.66 |
| Alloy #2 | 19.2 | 0.16 | 0.29 | 0.31 | 8.10 | 71.90 |

2. Both alloys were jaw crushed under nitrogen atmosphere to 3 millimeters and smaller.

3. Material from step 2 was then impact milled under nitrogen to produce -50 mesh (less than 400 micron particles). Liquid nitrogen was fed to the grinding chamber to remove the heat of grinding and to maintain the brittleness of the alloy to facilitate more efficient size reduction and to minimize the introduction of deformation-induced defects. Material larger than 50 mesh was returned to the impact mill for re-grinding.

4. Material from step 3 was then placed in a water-jacketed vacuum chamber. The -50 mesh powder was evacuated and then exposed to pure hydrogen gas by back-filling the chamber to −20 kPa gage pressure where the pressure was controlled as follows: as the alloy absorbed hydrogen, the hydrogen gas inlet valve opened to maintain the preset hydrogen partial pressure in the chamber. Hot water was used to initiate the hydrogen absorption reaction. Cool water was passed through the water jacket to reduce the temperature of the alloy prior to discharge from the chamber. The absorption of hydrogen is a strong exothermic reaction for these alloys. The analyzed composition (in atomic percent) of the hydrided alloys was as follows:

| | % H | % Nd | % Dy | % Pr | % Al | % B | % Fe |
|---|---|---|---|---|---|---|---|
| Alloy #1 | 19.8 | 12.7 | 0.06 | 0.19 | 0.42 | 5.37 | 61.51 |
| Alloy #2 | 20.3 | 15.3 | 0.13 | 0.23 | 0.25. | 6.45 | 57.25 |

5. Material from step 4 was then blended in the ratio of 70 parts Alloy #1 to 30 parts Alloy #2 and milled to 3.32 microns mean size as determined by a Fisher Sub-Sieve Sizer. This milling was done in an attritor using hexane as a protective fluid. Attriting time was 24 minutes after which the powder/hexane slurry was discharged to a settling tank. After five minutes, clear hexane was decanted away, and the denser slurry was loaded into an evaporator chamber.

6. Following a nitrogen purge of the evaporator chamber, 90° C. hot water was passed through the chamber wall to evaporate the hexane. When evaporation ceased, nitrogen was then passed through the chamber to displace the hexane vapor remaining in the chamber with the hydrided powder. After 15 minutes, a moderate vacuum (1 Torr) was applied to the chamber. After 15 minutes the chamber was backfilled with argon to atmospheric pressure and the hot water was replaced by cooling water to drop the powder temperature to 55,C. Then a harder vacuum (30 milli-torr) was applied to the chamber containing the hydrided powder. After 60 minutes, the chamber was backfilled with an air-nitrogen passivating gas. The content of the passivating gas was 2.5 volume percent oxygen in nitrogen. After the chamber gage pressure reached +14 kPa, a flow of 19 l/min was maintained for 4 hours to complete the passivation of the powder. At the conclusion of this treatment, the oxygen content of the hydrided powder was 0.812% by weight. The powder would not spontaneously ignite in air.

7. Powder from step 6 was placed in a die and oriented parallel to the direction of pressing using a magnetic field of 15.4 KOe.

8. Solid cylindrical disks 22.25 mm diameter ×6.35 mm long were compacted in a die at 2.8 metric ton/cm$^2$ pressure. The pressing direction was parallel to the direction of powder alignment.

9. Green compacts were then sintered under argon atmosphere at about 2 Torr vacuum partial pressure with a typical cycle as follows: heating slowly to 760° C. to allow hydrogen to desorb and purify the green compacts; heating to 1060° C.; sintering for four hours; immediately dropping the temperature to 925° C.; holding at 925° C. for two hours; cooling at 33° C./hr to 650° C.; holding at 650° C. for one hour; and cooling rapidly with nitrogen gas to room temperature.

10. Sintered magnets were then heat treated in vacuum for three hours at 510° C. to increase intrinsic coercivity.

11. Sample magnets were then prepared for testing by abrasive grinding. The sintered density was 7.36 g/cc. The final sintered magnet chemical composition (given in atomic %) was as follows:

| O % | % H | % Nd | % Dy | % Pr | % Al | % B | % Fe |
|---|---|---|---|---|---|---|---|
| 4.08 | 1.39 | 15.90 | 0.09 | 0.24 | 0.43 | 6.71 | 71.15 |

12. Using an applied magnetic field of 37 KOe, a complete hysteresis loop was obtained with the following result:

$B_r$=11.375 Gauss $H_c$=10,310 Oersteds $BH_{max}$=30.56 MGOE.

$H_{ci}$=11,310 Oersteds

If powder had been aligned perpendicular to the direction of pressing, higher $B_r$ and energy product values would have been expected.

Other magnets were prepared analogously to the magnet of the above example and the properties of the sintered and heat treated magnets were as follows:

| $H_{ci}$(KOe) | $H_c$(KOe) | $B_r$(KG) | $BH_{max}$(MGOe) | |
|---|---|---|---|---|
| Ex. 2[a, b] | 13.0 | 9.6 | 11.0 | 28.0 |
| Ex. 3[a, c] | 13.0 | 10.0 | 12.0 | 30.0 |
| EX. 4[d, b] | 17.0 | 10.2 | 11.0 | 28.0 |
| Ex. 5[d, c] | 17.0 | 10.2 | 11.8 | 30.0 |

[a]Initial composition (atomic percent) 15.9% Nd, 6.4% B, 0.4% Pr, 71.3% Fe
[b]Applied magnetic field aligned parallel to the direction of pressing
[c]Applied magnetic field aligned perpendicular to the direction of pressing
[d]Initial composition (atomic percent) 15.7% Nd, 1.1% Dy, 0.4% Pr, 6.4% B, 76.4% Fe

I claim:

1. A passivated hydrided particle having an overall composition comprising 8 to 30 atomic percent of a first constituent selected from the group consisting of rare earth metals, 42 to 90 atomic percent of a second constituent selected from the group consisting of transition metals and 2 to 28 atomic percent of a third constituent selected from the group consisting of boron, aluminum, gallium, indium and thallium, and having an intrinsic coercivity of greater than 1000 Oersted, a hydrogen content of 5 to 25 atomic percent and an oxygen content of 2 to 10 atomic percent.

2. A particle as defined in claim 1, having an overall composition comprising neodymium, iron and boron and having a hydrogen content of 24 atomic percent.

3. A particle as defined in claim 1 wherein the hydrogen content is 15 to 25 atomic percent.

4. A hydrided, passivated particle having an intrinsic coercivity of greater than 1000 Oersted, a hydrogen content of 5 to 25 atomic percent and an oxygen content of 2 to 10 atomic percent, said hydrided, passivated particle having been prepared by a process comprising the steps of (a) providing a particle formed of material having an overall composition comprising 8 to 30 atomic percent of a first constituent selected from the group consisting of rare earth metals, 42 to 90 atomic percent of a second constituent selected from the group consisting of transition metals and 2 to 28 atomic percent of a third constituent selected from the group consisting of boron, aluminum, gallium, indium and thallium, which material has been exposed to hydrogen gas under conditions such that the hydrogen gas is absorbed thereby; and exposing said particle of hydrided material to oxygen or an oxygen-containing gas in an amount, and for a time, sufficient to passivate said particle.

5. A particle as defined in claim 4 wherein the hydrogen content 15 to 25 atomic percent.

* * * * *